US011053640B2

(12) United States Patent
Swoboda et al.

(10) Patent No.: US 11,053,640 B2
(45) Date of Patent: Jul. 6, 2021

(54) TEXTURIZED PRINTABLE COATING AND METHODS OF MAKING AND USING THE SAME

(71) Applicant: Neenah, Inc., Alpharetta, GA (US)

(72) Inventors: Dean Swoboda, Alpharetta, GA (US); Brie Chaney-Ryan, Alpharetta, GA (US)

(73) Assignee: Neenah, Inc., Alpharetta, GA (US)

( * ) Notice: Subject to any disclaimer, the term of this patent is extended or adjusted under 35 U.S.C. 154(b) by 90 days.

(21) Appl. No.: 16/478,069

(22) PCT Filed: Dec. 15, 2017

(86) PCT No.: PCT/US2017/066632
§ 371 (c)(1),
(2) Date: Jul. 15, 2019

(87) PCT Pub. No.: WO2018/136178
PCT Pub. Date: Jul. 26, 2018

(65) Prior Publication Data

US 2020/0123709 A1 Apr. 23, 2020

Related U.S. Application Data

(60) Provisional application No. 62/446,954, filed on Jan. 17, 2017.

(51) Int. Cl.
*D21H 19/66* (2006.01)
*D21H 19/38* (2006.01)
(Continued)

(52) U.S. Cl.
CPC ..... *D21H 19/66* (2013.01); *D21H 19/385* (2013.01); *D21H 19/42* (2013.01); *D21H 19/54* (2013.01); *D21H 21/52* (2013.01)

(58) Field of Classification Search
None
See application file for complete search history.

(56) References Cited

U.S. PATENT DOCUMENTS 3,409,569 A 11/1968 Lane et al.
5,242,739 A 9/1993 Kronzer et al.
(Continued)

FOREIGN PATENT DOCUMENTS

EP 2684916 A1 1/2014
JP H0369693 A 3/1991
(Continued)

OTHER PUBLICATIONS

International Preliminary Report on Patentability issued for Application No. PCT/US2017/066632, dated Aug. 1, 2019.
(Continued)

*Primary Examiner* — Dennis R Cordray
(74) *Attorney, Agent, or Firm* — Meunier Carlin & Curfman LLC

(57) ABSTRACT

A texturized printable paper, along with methods of its formation and use, is provided. The texturized printable paper may include a base sheet having a first surface and a second surface, and a texturized printable coating on the first surface of the base sheet. The texturized printable coating may include a starch component; a plurality of first calcium carbonate particles having an average particle size of about 12 μm to about 50 μm; a plurality of oxide microparticles; and a plurality of polymeric microparticles having an average particle size of that is about 0.1 μm to about 1 μm.

20 Claims, 2 Drawing Sheets

(51) Int. Cl.

| | |
|---|---|
| ***D21H 19/42*** | (2006.01) |
| ***D21H 19/54*** | (2006.01) |
| ***D21H 21/52*** | (2006.01) |

(56) References Cited

U.S. PATENT DOCUMENTS

| | | | | |
|---|---|---|---|---|
| 5,501,902 | A | 3/1996 | Kronzer | |
| 5,798,179 | A | 8/1998 | Kronzer | |
| 6,231,970 | B1 | 5/2001 | Andersen et al. | |
| 6,372,361 | B1 | 4/2002 | Mackewicz et al. | |
| 2003/0152724 | A1 | 8/2003 | Swoboda et al. | |
| 2003/0175501 | A1 | 9/2003 | Concannon et al. | |
| 2005/0106357 | A1 | 5/2005 | Mayade et al. | |
| 2008/0038553 | A1 | 2/2008 | Avazzeri | |
| 2008/0311416 | A1* | 12/2008 | Kelly | D21H 21/54 428/537.5 |
| 2011/0224348 | A1 | 9/2011 | Aarni et al. | |
| 2012/0214007 | A1 | 8/2012 | Daniels et al. | |
| 2013/0011689 | A1 | 1/2013 | Reagan et al. | |

FOREIGN PATENT DOCUMENTS

| | | | |
|---|---|---|---|
| JP | 2001205920 | A | 7/2001 |
| JP | 2009013513 | A1 | 1/2009 |
| JP | 4819289 | B2 | 11/2011 |

OTHER PUBLICATIONS

Extended European Search Report issued in corresponding application No. EP 17893196.0, dated Jun. 30, 2020, 10 pages.
International Search Report and Written Opinion dated Feb. 21, 2018 in PCT/US2017/066632 (11 pages).

* cited by examiner

TEXTURIZED PRINTABLE COATING AND METHODS OF MAKING AND USING THE SAME

PRIORITY INFORMATION

The present application claims priority to U.S. Provisional Patent Application Ser. No. 62/446,954 titled "Texturized Printable Coating and Methods of Making and Using the Same" filed on Jan. 17, 2017, the disclosure of which is incorporated by reference herein.

FIELD OF TECHNOLOGY

The present subject matter is generally in the field of texturized printable paper, along with methods of its formation and use.

BACKGROUND

A textured substrate is a print media having a noticeable third dimension resulting from raised pattern portions. Such textured substrates are often used to provide a desirable tactile in products such as business cards, greeting cards, scrapbook pages, wallpaper, wrapping paper, and other paper and fabric-based merchandise. However, such textured substrates introduce difficulties in printing thereon, compared to relatively smooth printing surfaces.

For example, certain texturized substrates utilize granules within the printable surface to provide texture thereon. However, the printing media (e.g., ink) are not soluble within these granules, and thus lead to reduced print quality on the printable surface. Such granules tend to dust off of the printable surface, resulting in poor print quality as well as undesirable build-up on the printing roll and plate surfaces. Thus, the printable surface inhibits printable images. In practice, it is difficult to sufficiently adhere such granules to the coating while keeping the coating sufficiently porous to accept ink therethrough.

There is hence a need for a textured appearance produced on inexpensive substrates. There is also a need for improved printable textured substrates, particularly those that may be produced in a consumer environment.

BRIEF DESCRIPTION

Objects and advantages of the invention will be set forth in part in the following description, or may be obvious from the description, or may be learned through practice of the invention.

A texturized printable paper is generally provided, along with methods of its formation and use. In one embodiment, the texturized printable paper includes a base sheet having a first surface and a second surface, and a texturized printable coating on the first surface of the base sheet. The texturized printable coating generally includes a starch component; a plurality of first calcium carbonate particles having an average particle size of about 12 μm to about 50 μm; a plurality of oxide microparticles; and a plurality of polymeric microparticles having an average particle size of that is about 0.1 μm to about 1 μm.

For example, in one particular embodiment, the texturized printable coating generally includes about 5% to about 20% by weight of a starch component; about 5% to about 15% by weight of a plurality of first calcium carbonate particles having an average particle size of about 12 μm to about 50 μm; about 5% to about 25% by weight of a plurality of oxide microparticles; and about 25% to about 65% by weight of a plurality of polymeric microparticles having an average particle size of that is about 0.1 μm to about 1 μm.

The starch component may include amylose and amylophectin, and in particular embodiments may be crosslinked with a crosslinking agent (e.g., glyoxal or a glyoxal-based crosslinking agent). For instance, the starch component may include a greater than 0% to about 25% by of amylose and greater than 75% by weight amylopectin.

In one particular embodiment, the texturized printable coating further includes about 10% to about 40% by weight of a plurality of second calcium carbonate particles having an average particle size that is smaller than the first calcium carbonate particles. For instance, the second calcium carbonate particles may have an average particle size of about 0.5 μm to about 2.5 μm.

Methods are also generally provided for forming a texturized printable surface on a base sheet. In one embodiment, the method includes applying a coating precursor composition onto a first surface of a base sheet, where the coating precursor composition comprises a starch component, a first plurality of calcium carbonate particles having an average particle size of about 12 μm to about 50 μm, a plurality of oxide microparticles, and a plurality of polymeric microparticles having an average particle size of about 0.1 μm to about 1 μm.

In one embodiment, the method may further include drying the coating precursor composition to form a texturized printable coating comprising: about 5% to about 20% by weight of the starch component; about 5% to about 15% by weight of the first plurality of calcium carbonate particles having an average particle size of about 12 μm to about 50 μm; about 5% to about 25% by weight of the plurality of oxide microparticles; and about 25% to about 65% by weight of the plurality of polymeric microparticles having an average particle size of about 0.1 μm to about 1 μm.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth in the specification, which makes reference to the appended Figs., in which.

Figure 1:
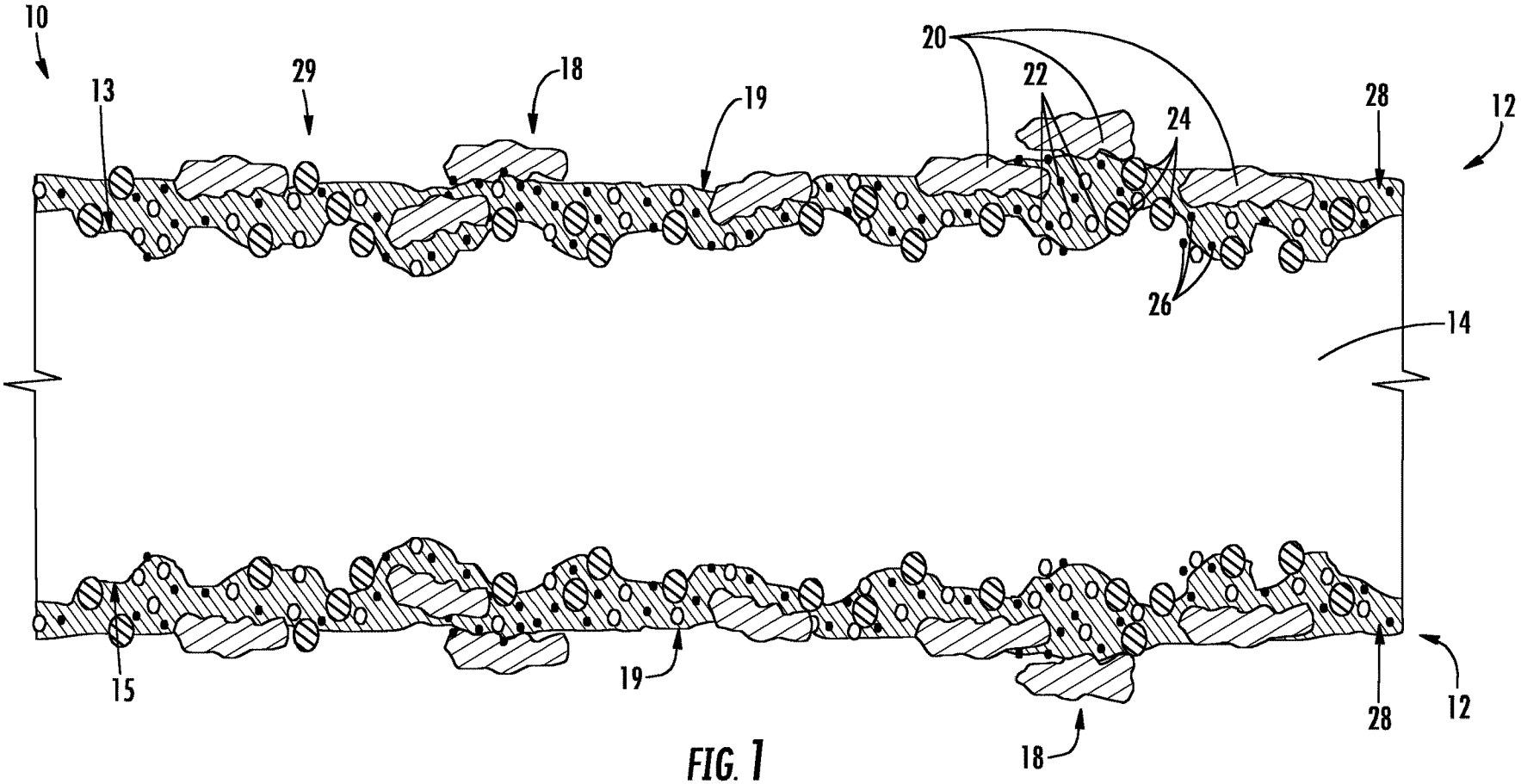
FIG. 1 shows a cross-sectional view of an exemplary texturized printable coating on a paper sheet.

Repeat use of reference characters in the present specification and drawings is intended to represent the same or analogous features or elements of the present invention.

Definitions

As used herein, the term "printable" is meant to include enabling the placement of an image on a material (e.g., a coating) by any means, such as by direct and offset gravure printers, silk-screening, typewriters, laser printers, laser copiers, other toner-based printers and copiers, dot-matrix printers, and ink jet printers, by way of illustration. Moreover, the image composition may be any of the inks or other compositions typically used in printing processes.

The term "molecular weight" generally refers to a weight-average molecular weight unless another meaning is clear from the context or the term does not refer to a polymer. It long has been understood and accepted that the unit for molecular weight is the atomic mass unit, sometimes referred to as the "dalton." Consequently, units rarely are given in current literature. In keeping with that practice, therefore, no units are expressed herein for molecular weights.

As used herein, the term "cellulosic nonwoven web" is meant to include any web or sheet-like material which contains at least about 50 percent by weight of cellulosic fibers. In addition to cellulosic fibers, the web may contain other natural fibers, synthetic fibers, or mixtures thereof. Cellulosic nonwoven webs may be prepared by air laying or wet laying relatively short fibers to form a web or sheet. Thus, the term includes nonwoven webs prepared from a papermaking furnish. Such furnish may include only cellulose fibers or a mixture of cellulose fibers with other natural fibers and/or synthetic fibers. The furnish also may contain additives and other materials, such as fillers, e.g., clay and titanium dioxide, surfactants, antifoaming agents, and the like, as is well known in the papermaking art.

As used herein, the term "polymer" generally includes, but is not limited to, homopolymers; copolymers, such as, for example, block, graft, random and alternating copolymers; and terpolymers; and blends and modifications thereof. Furthermore, unless otherwise specifically limited, the term "polymer" shall include all possible geometrical configurations of the material. These configurations include, but are not limited to isotactic, syndiotactic, and random symmetries.

DETAILED DESCRIPTION OF PARTICULAR EMBODIMENTS

Reference will now be made in detail to embodiments of the invention, one or more examples of which are provided herein. Each example is provided by way of explanation of the invention and not meant as a limitation of the invention. For example, features illustrated or described as part of one embodiment may be utilized with another embodiment to yield still a further embodiment. It is intended that the present invention include such modifications and variations as come within the scope of the appended claims and their equivalents.

A texturized printable paper is generally provided, along with its methods of manufacture and use. The texturized printable paper generally includes a texturized printable coating that has good printability without causing any significant dusting during the printing process. Additionally, the texturized printable coating can substantially retain its texturized surface after the printing process.

Referring to FIG. 1, a texturized printable paper 10 is generally shown having a texturized printable coating 12 on a first surface 13 of a base sheet 14 (opposite from a second surface 15 of the base sheet 14). In the embodiment shown, the texturized printable coating 12 includes a plurality of first calcium carbonate particles 20, a plurality of oxide microparticles 24, a plurality of polymeric microparticles 26, and a starch component 28 dispersed therein. Optionally, a plurality of second calcium carbonate particles 22 may be included within the texturized printable coating 12, with the second calcium carbonate particles 22 having a smaller average size than the first calcium carbonate particles 20. Each of these components of the texturized printable coating 12 is discussed in greater detail below.

The texturized printable coating 12 defines a printable surface 29 of the texturized printable paper 10, which includes peaks 18 and valleys 19 therein. The distance in the thickness (i.e., in the z-direction) of the peaks 18 and valleys 19 is a measure of the surface roughness (RA) of the printable surface 29. For example, the valleys 19 may have a thickness of about 3 μm to about 5 μm in the z-direction, such as in the areas containing the oxide microparticles 24, a plurality of polymeric microparticles 26, and a starch component 28 dispersed therein (but free from a calcium carbonate particle 20). The peaks 18 may have a thickness of about 15 μm to about 50 μm (where a single first calcium carbonate particle 20 is present), such as about 15 μm to about 25 μm. The peaks 18 may even have a thickness of about 25 μm to about 75 μm (where stacked first calcium carbonate particles 20 are present), such as about 25 μm to about 50 μm. In particular embodiments, the average surface roughness may be about 5 μm to about 50 μm (e.g., about 5 μm to about 25 μm, such as about 10 μm to about 20 μm).

Although shown applied to both the first surface 13 and the second surface 15 of the base sheet 14 in FIG. 1, the coating 12 may be applied to either surface to form the textured coating on the location as desired.

Figure 2:
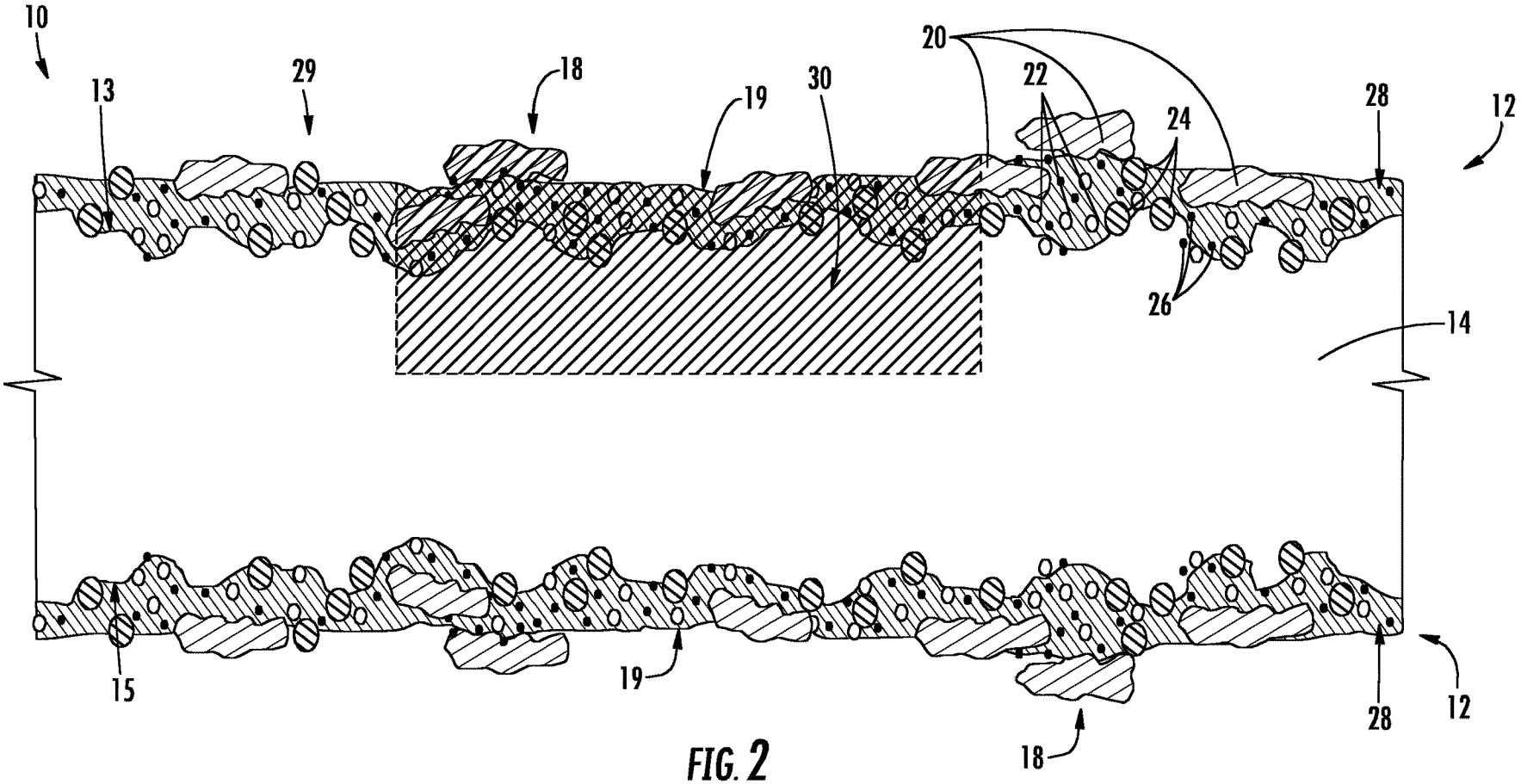
FIG. 2 shows a cross-sectional view of the exemplary texturized printable coating on a paper sheet with an image thereon.

As shown in FIG. 2, an ink 30 is applied onto at least a portion of the printable surface 29, which can form an image. The ink 30 may be applied onto the printable surface 29 via any suitable process, and may desirably applied via a printing process, such as ink jet printing, toner printing, flexographic printing, gravure printing, lithography, etc. The composition of the ink 30 may be tailored to the particular printing process utilized and still be applicable with the printable surface 29.

Although not shown in FIG. 1 or 2, optional intermediate coatings may optionally be positioned between the texturized printable coating 12 and the base sheet 14, if desired (e.g., an adhesive layer).

I. Plurality of Calcium Carbonate Particles 20

The calcium carbonate particles 20 are generally formed from at least about 90% by weight calcium carbonate ($CaCO_3$), such as at least about 98% by weight calcium carbonate. In one embodiment, the calcium carbonate particles 20 include calcium carbonate without the presence of any other materials, other than an insignificant amount of impurities (i.e., consists essentially of calcium carbonate).

The calcium carbonate particles 20 generally have an average particle size that is relatively large so as to provide surface texture to the coating, especially compared to the size of pigments typically used (i.e., about 1 micron in size). In one embodiment, the calcium carbonate particles 20 can have a size that is sufficiently large to be felt by the user. In one embodiment, the calcium carbonate particles 20 have an average particle size of about 12 μm to about 25 μm, such as about 15 μm to about 23 μm.

In embodiments where the base sheet 14 is a fibrous web (e.g., a paper web), the surface 13 of the base sheet 14 may define pores between fibers. In one embodiment, the pores within the surface 13 of the base sheet 14 may have any median average size that is greater than 10 μm (e.g., about 10 μm to about 100 μm, such as about 25 μm to about 100 um). As such, the calcium carbonate particles 20 may be positioned, at least partially, within pores on the surface 13 of the base sheet.

In certain embodiments, the coating 12 may include two calcium carbonate particles 20 at least partially stacked on one another. It is believed that the bonding between such stacked calcium carbonate particles 20 may be strong enough to anchor the stacked particles 20.

In one embodiment, the calcium carbonate particles 20 are generally shaped as an elongated rectangle-like particles having a thickness and width that are relatively similar (e.g., within about 10% of each other) and a longer length (e.g., the length is about 25% to about 250% longer than the width and/or thickness). This particular shape may provide increased surface area on the surface facing the base sheet 14 for bonding thereto, in order to keep the particle 20 securely within the coating. Additionally, such elongated rectangle-like particles may be particularly suitable for stacking two particles 20 on each other.

A sufficient amount of the calcium carbonate particles 20 are included within the texturized printable coating 12 to provide texture to the printable surface 16 in the form of peaks 18 and valleys 19, while still being able to be secured within the coating 12. In one embodiment, the texturized printable coating 12 includes about 5% to about 15% by weight of the plurality of calcium carbonate particles 20, such as about 7% to about 13%. In one particular embodiment, the texturized printable coating 12 includes about 8% to about 12% by weight of the plurality of calcium carbonate particles 20.

In embodiments where the second calcium carbonate particles 22 are present in the coating, the plurality of second calcium carbonate particles 22 may serve as a filling material between the cellulosic or other fibers within the base sheet 14 to fill pores therein, while also providing the desired sheet opacity. Generally, the second calcium carbonate particles 22 having a smaller average size than the first calcium carbonate particles 20. For example, the about 10% to about 40% by weight of a second plurality of calcium carbonate particles having an average particle size of about 0.5 μm to about 2.5 μm.

II. Plurality of Oxide Microparticles 24

Generally, the oxide microparticles 24 are present to aide in the ink adsorption and/or absorption of the texturized printable coating 12. As such, the plurality of oxide microparticles serve as an anchor to hold the printed image (e.g., formed by a ink-jet based ink and/or a toner ink) on the printable coating 12.

Without wishing to be bound by theory, it is believed that the oxide microparticles 24 add affinity for the inks of the printed image. Particularly suitable oxide microparticles 24 include, but are not limited to, silicon dioxide ($SiO_2$), aluminum oxide ($Al_2O_3$), aluminum dioxide ($AlO_2$), zinc oxide (ZnO), and combinations thereof. For example, it is believed that the metal-oxide porous microparticles (e.g., $SiO_2$) can absorb the ink liquid (e.g., water and/or other solvents) quickly. Additionally, it is believed that oxide microparticles (e.g., $SiO_2$) can add an available bonding site at the oxide that can ionically bond and/or interact (e.g., van der Waals forces, hydrogen bonding, etc.) with the ink binder and/or pigment molecules in the ink.

The oxide microparticles 24 can have an average diameter on the micrometer (micron or μm) scale, such as from about 1 μm to about 10 μm (e.g., about 3 μm to about 8 μm). Such oxide microparticles 24 can provide a sufficiently large surface area to interact with the ink composition applied to the printable coating 12. However, oxide microparticles 24 that are too large can lead to grainy images formed on the printable coating 12 and/or reduce the sharpness of any image formed therefrom.

The oxide microparticles 24 are present in the texturized printable coating 12 in a sufficient amount to also interact with the ink composition applied to dye sublimation coating 24. In one embodiment, the texturized printable coating 12 includes about 5% to about 25% by weight of a plurality of oxide microparticles 24.

III. Plurality of Polymeric Microparticles 26

The polymeric microparticles 26 generally aide in adhering the calcium carbonate particles 20, the optional calcium carbonate particles 22, and the oxide microparticles 24 within the texturized printable coating 12. Without wishing to be bound by theory, it is believed that the polymeric microparticles 26 create tack once heated during the application of the coating 12 onto the surface 13 of the base sheet 14 to hold the particles in place on the surface 13.

Generally, the texturized printable coating 12 includes a sufficient amount of the polymeric microparticles 26 to adhere the other particles within the coating 12 while retaining a level of micro-porosity within the coating layer to allow some ink to absorb and create adequate print ink density and other good print quality attributes. In one embodiment, the texturized printable coating 12 includes about 25% to about 65% by weight of a plurality of polymeric microparticles 26, such as about 30% to about 55% by weight. In one particular embodiment, the texturized printable coating 12 includes about 35% to about 50% by weight of a plurality of polymeric microparticles 26, such as about 37% to about 45% by weight.

The polymeric microparticles 26 generally include a polymeric material. In certain embodiments, the polymeric material of the polymeric microparticles 26 may include a polystyrene material, a polyacrylic material, a polyurethane material, a polyvinylacetate material, a polyvinyl material, a polybutadiene material, a polyolefin material, a polynitrile material, a polyamide material, a polyethylene oxide, epoxy materials, etc., and mixtures thereof.

In one particular embodiment, the polymeric microparticles 26 includes a styrene acrylic material. Polystyrene is an aromatic polymer made from the aromatic monomer styrene. Pure polystyrene is generally a long chain hydrocarbon with every other carbon connected to a phenyl group. "Isotactic polystyrene" generally refers to an isomer of polystyrene where all of the phenyl groups are on the same side of the hydrocarbon chain. Metallocene-catalyzed polymerization of styrene can produce an ordered "syndiotactic polystyrene" with the phenyl groups on alternating sides. This syndiotactic polystyrene is highly crystalline with a melting point of about 270° C. "Atactic polystyrene" generally refers to an isomer of polystyrene where the phenyl groups are randomly distributed on both sides of the hydrocarbon chain. This random positioning prevents the polymeric chains from ever aligning with sufficient regularity to achieve any significant crystallinity. As such, atactic polystyrene has no true melting point and generally melts over a relatively large temperature range, such as between about 90° C. and about 115° C. This relatively large melting temperature range allows the thermoplastic polystyrene microparticles to resist melting and flowing at the temperatures briefly encountered during formation of the coating 12 on the surface 13 of the base sheet 14.

The melting point of the thermoplastic polystyrene microparticles is influenced by the molecular weight of the thermoplastic polystyrene microparticles, although the melting point can be influenced by other factors. In one embodiment, the weight average molecular weight ($M_w$) of the thermoplastic polystyrene polymer in the microparticles can be from about 10,000 g/mol to about 1,500,000 g/mol and the number average molecular weight.

Without wishing to be bound by any particular theory, it is believed that controlling the particle size of the polymeric microparticles 26 is particularly important in controlling the adherence of the polymeric microparticles 26 to the other particles during formation of the coating 12. Generally, the polymeric microparticles 26 are large enough to provide a sufficient surface to adhere the other particles within the coating 12, but small enough so as to avoid interfering with the sharpness of the image to be transferred. In the embodiment shown, the polymeric microparticles 26 generally keep their shape after forming the coating 12, although deformation may be seen in each microparticle 26.

In particular embodiments, the polymeric microparticles 26 have an average particle size (diameter) that is about 1 μm or less (e.g., about 0.5 μm to about 1 μm), such as about 0.07 μm to about 0.09 μm. As such relatively small sizes, the polymeric microparticles 26 have a relatively large surface area for binding between other components (e.g., the inorganic particles, the base sheet component (e.g., fibers), and/or the starch component). Additionally, the polymeric microparticles 26 are relatively small enough to fit in pores between such components for binding.

For example, the polymeric microparticles 26 can be acrylic styrene particles having an average diameter of about 0.08 μm and an average molecular weight of 12,000 g/mol, such as the ultra-fine particles available under the trade name FennoBind P45 S (commercially available from company Kemira).

IV. Starch Component 28

The starch component 28 generally serves as a medium to hold the combination of particles within the coating 12 and onto the base sheet 14, and to provide cohesion and mechanical integrity to the coating 12. Generally, starch is a carbohydrate that includes glucose monomer units with two types of arrangement: amylose and amylopectin. Amylose is a linear polymer of glucose units that are connected to each other through a-link. There are about 1.6% of the glucose units connected by a-link, and they are attached to the main structure of amylose, which leads to the branched structure of amylose. Amylopectin is a large and branched polysaccharide that the main structure of molecule is similar to amylose. Natural starch, depending on the source, generally includes about 20% by weight to about 25% by weight amylose and about 75% by weight to about 80% by weight amylopectin. In one embodiment, the starch component has such a ratio of amylose to amylopectin (e.g., about 20% by weight to about 25% by weight amylose and about 75% by weight to about 80% by weight amylopectin).

The texturized printable coating 12 generally includes a sufficient amount of the starch component 28 to bind the various particles, particularly the calcium carbonate particles 20, to the base sheet 14. In one embodiment, the texturized printable coating 12 includes about 5% by weight to about 20% by weight of a starch component 28, such as about 5% by weight to about 15% by weight. In one embodiment, the texturized printable coating 12 includes about 8% by weight to about 12% by weight of a starch component 28.

In one embodiment, a crosslinking agent may be included along with the starch component 28 in the coating precursor composition that, when applied onto the base sheet 14, results in the printable coating 12. The crosslinking agent reacts with the starch component 28 to form a crosslinked starch in the resulting coating 12, which can convert the starch component 28 to a more insoluble component. As such, the binding characteristics and the durability, particularly when exposed to solvents (e.g., water), of the coating 12 may be improved. The crosslinking agent may be present in the dried coating up to about 2% by weight (e.g., about 0.1% by weight to about 1% by weight, such as about 0.1% by weight to about 0.5% by weight). For example, particularly suitable crosslinking agents are glyoxal and glyoxal-based crosslinkers, such as those available commercially as the Earthworks Link-Up Plus series from T Square, Inc. (Charlotte, N.C.).

The starch component 28 may be provided in the form of starch nanoparticles in the coating precursor composition, such as described below. However, after formation of the coating 12, the starch component 28 may form a matrix that aides in binding the inorganic particles within the coating 12.

V. Base Sheet 14

The base sheet 14 is typically a polymeric film or a cellulosic nonwoven web (e.g., a paper sheet). The base sheet 12 provides strength for handling, coating, sheeting, other operations associated with the manufacture thereof. The basis weight of the base sheet 12 generally may vary, such as from about 10 g/m$^2$ to about 400 g/m$^2$. Suitable base sheets 12 include, but are not limited to, cellulosic nonwoven webs and polymeric films. A number of suitable base sheets 12 are disclosed in U.S. Pat. Nos. 5,242,739; 5,501,902; and 5,798,179; the entirety of which are incorporated herein by reference.

Desirably, the base sheet 12 comprises paper. A number of different types of paper are suitable including, but not limited to, common litho label paper, bond paper, and latex saturated papers. The base sheet 12 is readily prepared by methods that are well known to those having ordinary skill in the art.

The components of the texturized printable coating 12 may be dispersed within a solvent to form a coating precursor composition such that, when applied onto the first surface 13 of the base sheet 14, the coating precursor composition forms the printable coating 12. The coating precursor composition generally includes the relative amounts of the solid components suitable for the desired dried weights of the components of the printable coating 12.

Other additives, such as processing agents, may also be present in the coating precursor composition, including, but not limited to, thickeners, dispersants, emulsifiers, viscosity modifiers, humectants, pH modifiers etc. Surfactants can also be present in the coating precursor composition to help stabilize the emulsion prior to and during application. For instance, the surfactant(s) can be present in the printable coating 12 up to about 5% by weight, such as from about 0.1% by weight to about 1% by weight, based upon the weight of the dried coating. Exemplary surfactants can include nonionic surfactants, such as a nonionic surfactant having a hydrophilic polyethylene oxide group (on average it has 9.5 ethylene oxide units) and a hydrocarbon lipophilic or hydrophobic group (e.g., 4-(1,1,3,3-tetramethylbutyl)-phenyl), such as available commercially as Triton® X-100 from Rohm & Haas Co. of Philadelphia, Pa. In one particular embodiment, a combination of at least two surfactants can be present in the printable coating.

Viscosity modifiers can be present in the coating precursor composition. Viscosity modifiers are useful to control the rheology of the coatings in their application. For example, sodium polyacrylate (such as Paragum 265 from Para-Chem Southern, Inc., Simpsonville, S.C.) may be included in the coating precursor composition. The viscosity modifier can be included in any amount, such as up to about 5% by weight, such as about 0.1% by weight to about 1% by weight, of the dried weight of the printable coating 12.

The coating precursor composition may be applied to the base sheet 14 by known coating techniques to form the printable coating 12, such as by roll, blade, Meyer rod, and air-knife coating procedures. Alternatively, the coating precursor composition may be a film laminated to the base sheet

14. The resulting texturized printable paper 10 then may be dried by means of, for example, steam-heated drums, air impingement, radiant heating, or some combination thereof. The texturized printable coating 12 can, in one particular embodiment, be formed by applying a polymeric emulsion onto the tie coating on the surface of the base sheet, followed by drying.

The coat weight of the texturized printable coating 12 generally may vary from about 1 g/m$^2$ to about 70 g/m$^2$, such as from about 3 g/m$^2$ to about 50 g/m$^2$. In particular embodiments, the coat weight of the texturized printable coating 12 may vary from about 5 g/m$^2$ to about 40 g/m$^2$, such as from about 7 g/m$^2$ to about 25 g/m$^2$.

Examples

The following materials were used:

EcoSphere 2330 (EcoSynthetix, Inc., Burlington, Ontario) is a starch solution;

Hydrocarb® 60 Calcium Carbonate (Omya North America) is plurality of fine ground $CaCO_3$ particles having an average particle size of about 1.4 μm in a slurry;

Sylysia 440 (Fuji Silysia Chemical) is a micronized synthetic amorphous silica-gel having an average particles size of 6.2 μm;

MicroWhite #10 (Imerys) is a plurality of medium ground $CaCO_3$ particles having an average particle size of about 12-14 μm in a slurry;

Fennobind P45 S (Kemira) is a slurry of ultra-fine particles having an average particles size of about 0.08 μm;

Link-Up Plus (Earthworks) is a crosslinking agent; and

Rhoplex TT-935 (The Dow Chemical Company) is a rheology modifier with a dual mechanism, and serves as a thickener.

A coating precursor composition was formed according to Table 1 below, shown by weight:

TABLE 1

| Name | Parts per 100 (wet) | Parts per 100 (dry) |
|---|---|---|
| water | 18.43 | 0.00 |
| EcoSphere 2330 | 10.21 | 9.62 |
| Hydrocarb 60 $CaCO_3$ slurry | 10.81 | 23.57 |
| Sylysia 440 (20% dispersion) | 25.23 | 14.86 |
| 15um $CaCO_3$ | 3.30 | 9.73 |
| Fennobind P45 S | 31.24 | 41.40 |
| Link-Up Plus | 0.29 | 0.40 |
| TT-935 thickener | 0.48 | 0.42 |

The coating precursor composition of Table 1 was applied to both surfaces of a paper sheet by air knife coating deposition at a coating weight of about 25 g/m$^2$ after drying with heated forced air.

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only, and is not intended to limit the invention so further described in the appended claims.

What is claimed is:

1. A texturized printable paper, comprising:

a base sheet having a first surface and a second surface; and a texturized printable coating on the first surface of the base sheet, wherein the texturized printable coating comprises:

a starch component;

a plurality of first calcium carbonate particles having an average particle size of about 12 μm to about 50 μm;

a plurality of oxide microparticles; and a plurality of polymeric microparticles having an average particle size of that is about 0.07 μm to about 1 μm.

2. The texturized printable paper of claim 1, wherein the texturized printable coating comprises:

about 5% to about 20% by weight of the starch component;

about 5% to about 15% by weight of the plurality of first calcium carbonate particles having an average particle size of about 12 μm to about 50 μm;

about 5% to about 25% by weight of the plurality of oxide microparticles; and about 25% to about 65% by weight of the plurality of polymeric microparticles having an average particle size of that is about 0.07 μm to about 1 μm.

3. The texturized printable paper of claim 1, wherein the starch component comprises amylose and amylopectin.

4. The texturized printable paper of claim 1, wherein the starch component comprises less than 25% by weight of amylose and greater than 75% by weight amylopectin.

5. The texturized printable paper of claim 1, wherein the starch component is crosslinked with a crosslinking agent, wherein the texturized printable coating comprises about 0.1% to about 2% by weight of the crosslinking agent.

6. The texturized printable paper of claim 5, wherein the crosslinking agent comprises glyoxal or a glyoxal-based crosslinking agent.

7. The texturized printable paper of claim 1, wherein the first calcium carbonate particles have an average particle size of about 12 μm to about 25 μm, and wherein the texturized printable coating comprises about 7% to about 13% by weight of the first calcium carbonate particles.

8. The texturized printable paper of claim 7, wherein the first calcium carbonate particles have an average particle size of about 15 μm to about 23 μm, and wherein the texturized printable coating comprises about 8% to about 12% by weight of the first calcium carbonate particles.

9. The texturized printable paper of claim 1, wherein the first calcium carbonate particles have a thickness and a width that are within about 10% of each other, and wherein the first calcium carbonate particles have a length that is about 25% to about 250% longer than the width.

10. The texturized printable paper of claim 1, wherein the texturized printable coating further comprises:

about 10% to about 40% by weight of a plurality of second calcium carbonate particles having an average particle size that is smaller than the first calcium carbonate particles.

11. The texturized printable paper of claim 10, wherein the second calcium carbonate particles have an average particle size of about 0.5 μm to about 2.5 μm.

12. The texturized printable paper of claim 1, wherein the oxide microparticles have an average particle size that is smaller than the first calcium carbonate particles.

13. The texturized printable paper of claim 1, wherein the oxide microparticles have an average particle size of about 1 μm to about 10 μm.

14. The texturized printable paper of claim 1, wherein the oxide microparticles comprise silica microparticles.

15. The texturized printable paper of claim 1, wherein the texturized printable coating comprises about 37% to about 45% by weight of the plurality of polymeric microparticles, and wherein the plurality of polymeric microparticles have an average particle size of about 0.07 μm to about 0.09 μm.

16. The texturized printable paper of claim 1, wherein the plurality of polymeric microparticles include a polystyrene material, a polyacrylic material, a polyurethane material, a polyvinylacetate material, a polyvinyl material, a polybutadiene material, a polyolefin material, a polynitrile material, a polyamide material, a polyethylene oxide, epoxy materials, or a mixture thereof.

17. The texturized printable paper of claim 1, wherein the base sheet comprises a paper sheet.

18. The texturized printable paper of claim 1, wherein the texturized printable coating defines a printable surface having a surface roughness of about 5 μm to about 25 μm.

19. A method of forming a texturized printable surface on a base sheet, the method comprising:

applying a coating precursor composition onto a first surface of a base sheet, wherein the coating precursor composition comprises a starch component, a plurality of calcium carbonate particles having an average particle size of about 12 μm to about 50 μm, a plurality of oxide microparticles, and a plurality of polymeric microparticles having an average particle size of about 0.07 μm to about 1 μm.

20. The method of claim 19, further comprising:

drying the coating precursor composition to form a texturized printable coating comprising:

about 5% to about 20% by weight of the starch component;

about 5% to about 15% by weight of the plurality of calcium carbonate particles having an average particle size of about 12 μm to about 50 μm;

about 5% to about 25% by weight of the plurality of oxide microparticles; and about 25% to about 65% by weight of the plurality of polymeric microparticles having an average particle size of about 0.07 μm to about 1 μm.

* * * * *